US005571562A

United States Patent [19]

Wakat

[11] Patent Number: 5,571,562

[45] Date of Patent: Nov. 5, 1996

[54] METHOD OF PRODUCING A MULTI-PATTERNED COATING

[75] Inventor: George H. Wakat, St. Paul Park, Minn.

[73] Assignee: Master Coating Technologies, Inc., Eagan, Minn.

[21] Appl. No.: 154,152

[22] Filed: Nov. 17, 1993

Related U.S. Application Data

[63] Continuation of Ser. No. 785,023, Oct. 30, 1991, abandoned.

[51] Int. Cl.[6] ..... B05D 5/00

[52] U.S. Cl. ..... 427/280; 427/426; 118/315

[58] Field of Search ..... 427/262, 263, 427/280, 281, 426; 118/315

[56] References Cited

U.S. PATENT DOCUMENTS

| | | | |
|---|---|---|---|
| 1,427,454 | 8/1922 | Gates | 118/315 |
| 2,504,117 | 4/1950 | Downs | 427/280 |
| 2,696,449 | 12/1954 | Ericks et al. | 427/280 |
| 3,135,467 | 6/1964 | Greenman . | |
| 3,672,570 | 6/1972 | Scarbrough et al. . | |
| 3,674,205 | 7/1972 | Kock . | |
| 4,061,599 | 12/1977 | Marlor | 427/421 |
| 4,133,483 | 1/1979 | Henderson . | |
| 4,193,546 | 3/1980 | Hetherington et al. . | |
| 4,204,645 | 5/1980 | Hopp . | |
| 4,236,674 | 12/1980 | Dixon . | |
| 4,281,683 | 8/1981 | Hetherington et al. . | |
| 4,297,258 | 10/1981 | Long, Jr. . | |
| 4,361,283 | 11/1982 | Hetherington et al. . | |
| 4,411,387 | 10/1983 | Stern et al. . | |
| 4,497,341 | 2/1985 | Wright . | |
| 4,643,357 | 2/1987 | Culbertson et al. . | |
| 4,673,596 | 6/1987 | Shoji et al. | 427/263 |
| 4,692,358 | 9/1987 | Marsden et al. . | |
| 4,795,096 | 1/1989 | Smith . | |
| 4,917,300 | 4/1990 | Gloviak et al. . | |
| 4,927,079 | 5/1990 | Smith . | |

FOREIGN PATENT DOCUMENTS

| | | |
|---|---|---|
| 2608466 | 6/1986 | France . |
| 2618087 | 7/1987 | France . |
| 2038916 | 2/1971 | Germany . |
| 3534269 | 4/1987 | Germany . |

OTHER PUBLICATIONS

*The Next Logical Step in the Evolution of Wall Finishes*, Polomyx Industries, Inc., (1989). (no month date).

*Zolatone®*, Zolatone Process, Inc. (1987). (no month date).

*Color. What the Best Dressed Walls Will Be Wearing*, Multiflek Paint Systems Inc. (undated).

*Nozzle and Needle Selection Charts for Air Spray Guns*, Bulletin A467–4R–9, Binks Manufacturing Company, Apr. 1990.

*Binks Model 2001 & 2001V Spray Gunds, Operation, Maintenance, and Conversion*, Binks Manufacturing Company, Part Sheet 2316R–3, pp. 2–11, Jun. 1988.

*Binks Spray Guns, specifications and guide to selection*, Binks Manufacturing Company, Bulletin A54–19R–11, pp. 6–16, undated.

*Primary Examiner*—Katherine Bareford

*Attorney, Agent, or Firm*—Westman, Champlin & Kelly, P.A.

[57] ABSTRACT

A multiple nozzle coating apparatus and method which simultaneous propels a plurality of coating compositions in substantially overlapping coating patterns. The coating compositions are formulated with a viscosity and rheology control agent to have sufficient wet strength to stand alone and not flow or readily mix with itself when applied under non-atomizing conditions. A separate nozzle is provided for each of the viscous coating compositions configured to create overlapping coverage over the area coated. The separate coating nozzles are inclined toward a substantially overlapping coat pattern. The coating compositions and compressed air are delivered to the separate nozzles. Adjustable valves are provided for releasing coating compositions and the compressed air from each of the nozzles to simultaneously propel coating compositions away from each of the nozzles to form a coat pattern wherein the coating compositions remaining substantially separate after being propelling.

10 Claims, 6 Drawing Sheets

METHOD OF PRODUCING A MULTI-PATTERNED COATING

This is a continuation, of application Ser. No. 07/785,023, filed Oct. 30, 1991, now abandoned.

BACKGROUND OF THE INVENTION

The general methods for applying different colors and/or textures of coatings in such fashion that the colors remain distinctively separate after application include the application of each coating individually or the use of hydrophobic alkyd paints. Application of each coating individually is extremely labor-intensive. For industrial applications, the associated shutdown time often makes the use of multiple colors and/or textures of coatings cost-prohibitive. Further, when coatings are applied individually, each subsequent coat tends to dominate or obscure previous coats.

It might be thought that a use of several applicators would produce multiple colors of paint. Typical coating compositions and applicators such as coating guns, however, operate under conditions designed to deliver complete coverage. If several applicators are used simultaneously, the coating droplets tend to be so fine or atomized and so close together that the individual coatings will combine into a single, uniform coverage. There will be no color differentiation and the individual color/texture coatings will mix to form a composite color/texture. Thus, known plural component coating technology focuses on mixing a plurality of components either prior to or during the coating process. For example, U.S. Pat. No. 4,297,079, issued to Smith, discloses a plural component air coating gun that atomizes the two fluids into an atomized conical coat, thereby mixing the two liquid materials before they contact the surface to be coated. Such methods do not produce a multi-color surface generally.

Some attempts to produce multi-color surfaces have focused upon specially formulated multi-color coatings which are available as single coatings. In these paints, the droplets of each coating are agglomerated or encapsulated in soft breakable microcapsules. However, such agglomerated coatings are extremely expensive and have an extremely low solid to volume ratios, generally about 12.5% to 20%. Further, since the agglomerated microcapsules are designed to splatter when they hit the surface being coated, encapsulated coatings lack the strong binders needed to produce a durable surface that can stand up to solvents and harsh cleaners. Consequently, these coatings cannot be used for floors, exteriors, or industrial applications. One example of encapsulated paints is Zolatone®.

Moreover, the agglomerated color microcapsules are generally very small, which limits the variability of texture or streak size. In order to force the color microcapsules through the coat system, agglomerated coatings must be coated at a high pressure, creating a wasteful fog of coating material. Finally, agglomerated coatings generally require a base color coat to achieve complete coverage of the surface.

Therefore, it is an object of the invention to develop a coating composition, apparatus and method for producing a multi-color and multi-effect surface. A further object is the development of a process for producing a multi-color and multi-effect surface in one coating application.

SUMMARY OF THE INVENTION

These and other objects are achieved by the present invention which are directed to a method utilizing a viscous coating composition and apparatus for simultaneously applying multiple colors and/or multiple effects of the coating compositions that remain distinctively separate on the surface coated. In particular, multiple atomizing coating guns, which may be fitted with special effects adapters in some circumstances, are subjected to reduced air and fluid pressure to substantially prevent atomization of the viscous coating composition. The multiple effect guns are positioned to create a series of conical, overlapping coating patterns. The viscous coating compositions reach the surface to be coated substantially simultaneously, while retaining their distinctive effect composed of color, texture and shape.

The apparatus of the present invention includes a plurality of coating guns focused to create overlapping conical patterns on a given surface. A single control mechanism activates the coating guns simultaneously and a special fixture arrangement allows large surfaces to be coated effectively. The apparatus may utilize special effects adapters in conjunction with low air pressure to reduce or prevent atomization of the viscous coating compositions.

The viscous coating compositions of the present invention are formulated to minimize mixing and atomization during application. Generally, the viscous coating compositions will include a carrier, a film-forming agent, preferably polymeric, a coating pigment such as a coloring agent or metal or non-metal particulate, and a viscosity and rheology control agent that maintains the body of the composition in the wet state at rest and under shear conditions.

The properties of the viscosity and rheology control agent, the liquid flow and resistance properties set up by the carrier, film-forming agent and coating pigment in combination with the process parameters provided by the nozzle configuration and flow pressure cause the coating composition to extrude from the liquid nozzle in different sized segments. The extrusion allows large "pieces" of composition to be propelled as single bodies to the surface to be coated. The result is a plurality of overlapping coating materials which individually provide incomplete coverage of the surface, but when taken together coat the entire surface. The shape retaining bodies of the composition do not mix or recombine but maintain their individual identities on the surface.

Any coating or covering material can be reformulated according to the parameters of the viscous coating composition and be used in the method and apparatus of the present invention. By choosing the correct combination of air pressure, fluid pressure, special effects adapters, and composition viscosity, different surface effects of shape, texture, and color can be achieved through the invention.

BRIEF DESCRIPTION OF THE INVENTION

DETAILED DESCRIPTION OF THE INVENTION

Figure 1:
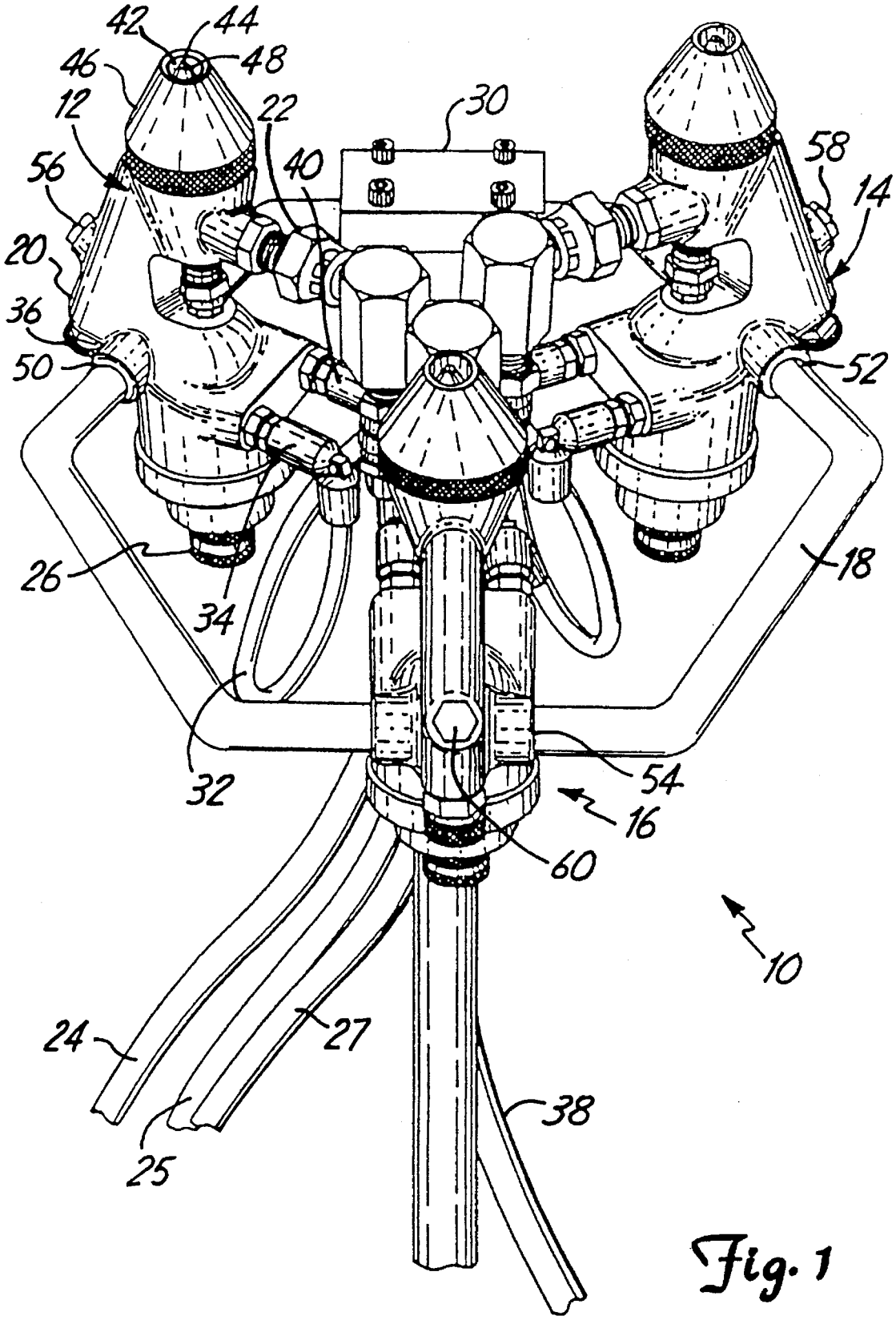
FIG. 1 is a perspective view of the first embodiment of the multiple nozzle coating apparatus of the present invention.

FIG. 1 illustrates a pneumatically actuated multiple nozzle coating apparatus 10 of the present invention. In the first embodiment of the present invention, three coating guns 12, 14, and 16 are attached in close proximity to each other on a hexagonal fixture 18. Since each coating gun consists of essentially the same elements, only coating gun 12 will be described in detail. It will be understood that all the components and functionality of coating gun 12 is present in coating guns 14 and 16.

The coating gun 12 consists of coating gun bodies 20 and a fitting 22 for attaching a viscous coating composition supply hoses 24. Viscous coating composition hoses 25 and 27 are provided for coating guns 14 and 16, respectively. An adjustable stop 26 with locking ring (not shown) is provided to control the volume of coating to be extruded through the nozzle. This adjustment will alter size and shape of coating being applied.

Regulated air supply through extension pole 28 provides compressed air to a distribution manifold 30 attached to the hexagonal fixture 18. The pressurized air propels the viscous coating composition. Air hose 32 is attached to the distribution manifold 30 at one end an to a coating guns air fittings 34 on the coating gun 12 at the other end. A similar hose is attached to coating guns 14 and 16. On the rearward side of the coating gun body 20 a valve 36 is provided for adjusting the air pressure and flow. As will be discussed in more detail below, adjusting the air pressure also alters the size and shape of the coating being applied.

The coating gun body 20 is formed with a plurality of passageways (not shown) through which the compressed air and viscous coating composition flows. An air cylinder (not shown) is contained in the coating gun body 20 for releasing the compressed air and the viscous coating compositions. The air cylinder in coating gun 12 is activated pneumatically, by compressed air from the valve actuation air hose 38, which is attached to the fitting 40. It will be understood by those skilled in the art that a variety of approaches are available to simultaneously trigger the coating guns 12, 14, and 16.

Fluid nozzles 42 is mounted on the forward end of the coating gun bodies 20. The fluid nozzles 42 includes a centrally disposed fluid aperture 44 through which the viscous coating composition is extruded. Surrounding the fluid nozzle 42 is an air cap 46, which forms a space 48. The compressed air flows in the space 48 between the air cap 46 and the fluid nozzle 42, to break up and propel the viscous coating composition as it is released from the fluid aperture 44.

By reducing the air flow through the space 48, larger quantities (or strings) of coating material will form on the fluid nozzle before being propelled to the surface being coated. The reverse is also true.

Figure 2A:
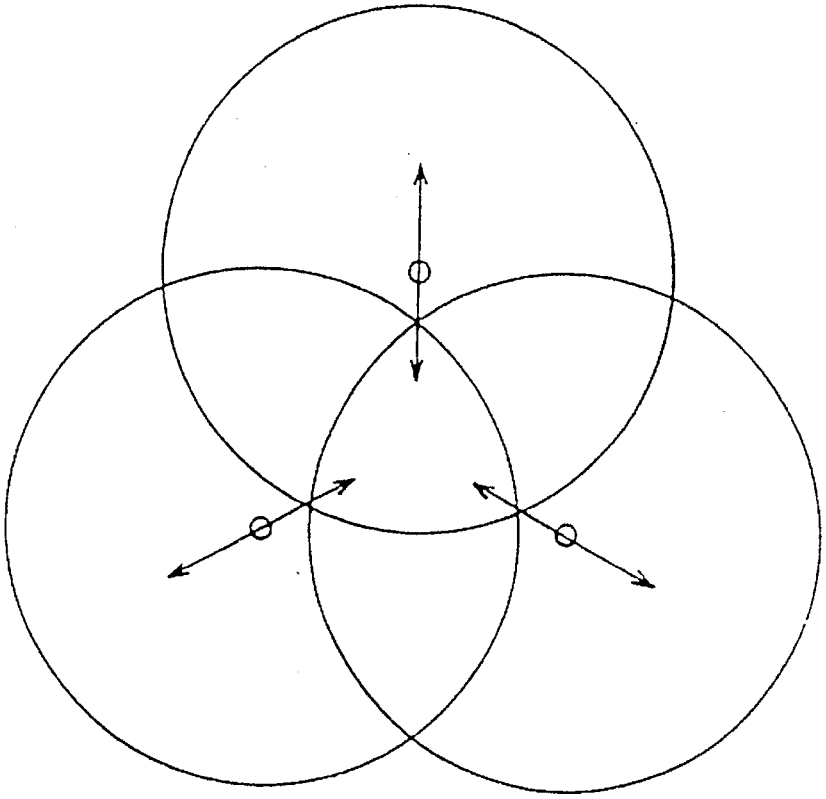
FIG. 2A is representation of the coating pattern generated when the coating guns of the first embodiment are positioned parallel to each other.
Figure 2B:
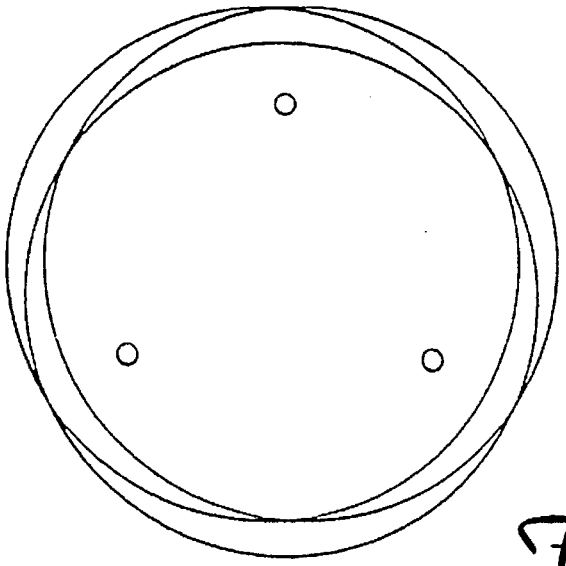
FIG. 2B is representation of the coating pattern generated when the coating guns of the first embodiment are positioned to form a substantially overlapping coating pattern.

The coating guns 12, 14, and 16 are mounted to the hexagonal fixture 18 at pivot points 50, 52, and 54, respectively. If the coating guns are maintained parallel to each other, the coat pattern illustrated in FIG. 2A will result. However, the pivot points allow the guns to be focused to create a substantially overlapping coating pattern, as illustrated in FIG. 2B. Set screws 56, 58 and 60 secure the coating guns 12, 14, and 16, respectively, in the focused position. It will be understood that the size of the coat patterns illustrated in FIGS. 2A and 2B will increase the further the coating guns are from the surface to be coated. By changing the angle of each coating gun, the focal point of the coat pattern can be varied to compensate for the distance to the surface.

Figure 3:
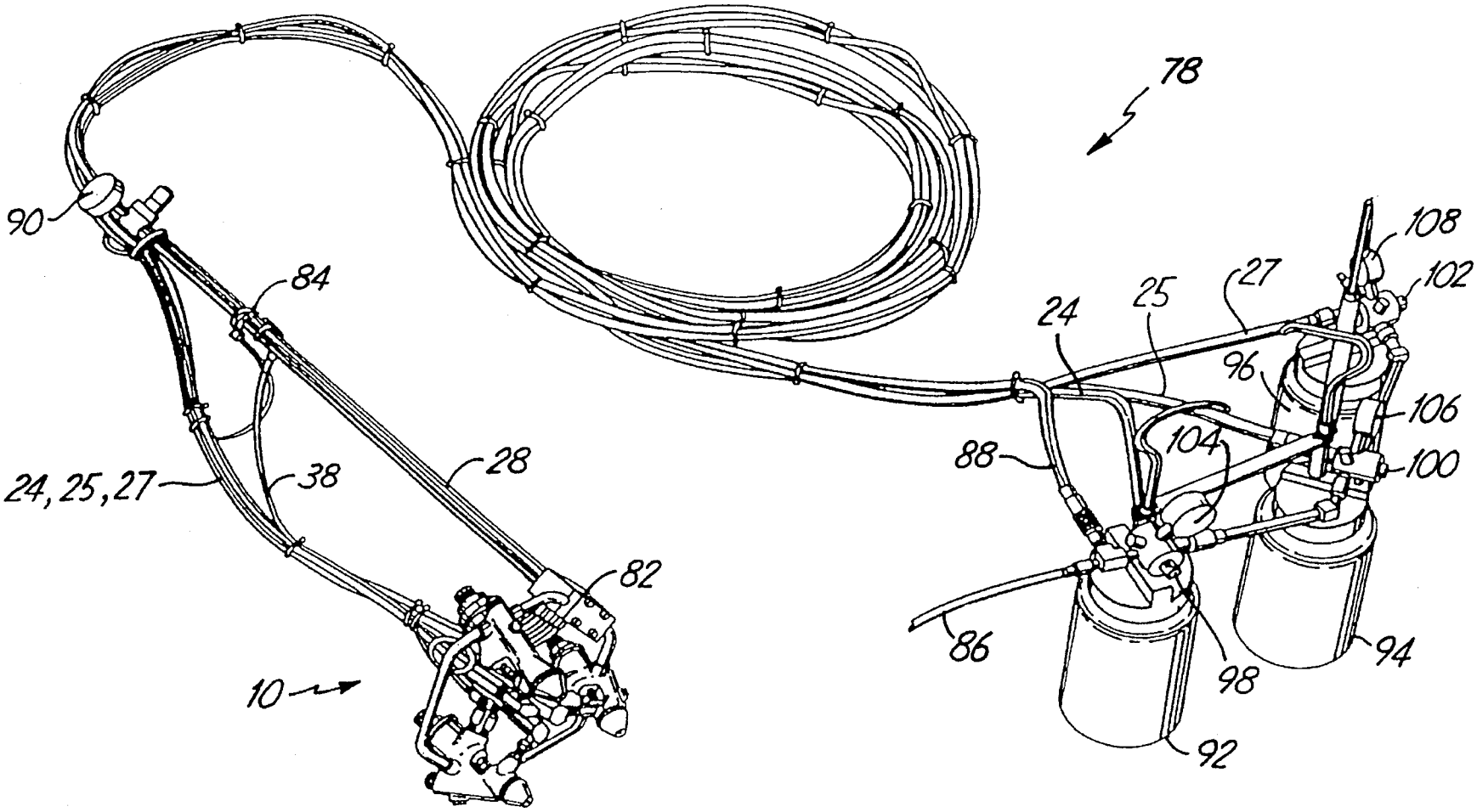
FIG. 3 is a perspective view of the coating apparatus of the first embodiment.

FIG. 3 illustrates the entire coating apparatus 78 of the present invention. The hexagonal fixture 18 is attached to an extension pole 28 via a universal joint 82, which maintains the coating apparatus in a substantially vertical position. The extension pole 28 provides the multiple nozzle coating apparatus 10 with a regulated air supply and the necessary mobility to coat large surfaces.

Compressed air is supplied to the system 78 through a main supply air hose 86 from a compressed air source (not shown). Compressed air is supplied to a triggering device 84 on the extension pole 28 via a primary air hose 88. The triggering device 84 allows the coating guns 12, 14 and 16 to be activated simultaneously. The triggering device 84 activates an air cylinder (not shown) which opens up the paint and air flow to each gun 12, 14, and 16. A pressure regulator and gauge 90 is provided on the extension pole 28 for controlling and adjusting the air pressure used to propel the coating.

Three composition pots 92, 94 and 96 are connected to the main supply air hose 86 through regulator assemblies 98, 100, and 102, respectively. The regulator assemblies 98, 100, and 102 allow the incoming air pressure to each paint pot to be adjusted independently, while monitoring the pressure gauges 104, 106 and 108, respectively.

Viscous coating composition supply hoses 24, 25, and 27 are connected to the composition pressure pots 92, 94, and 96, respectively. Air pressure from the main supply air hose 86 through regulators 98, 100, 102 forces the viscous coating compositions through their respective viscous coating composition supply hoses to each of the coating guns 12, 14, and 16. The air cylinder (not shown) prevent the viscous coating composition from passing through the fluid apertures until the air cylinders are actuated.

Figure 4:
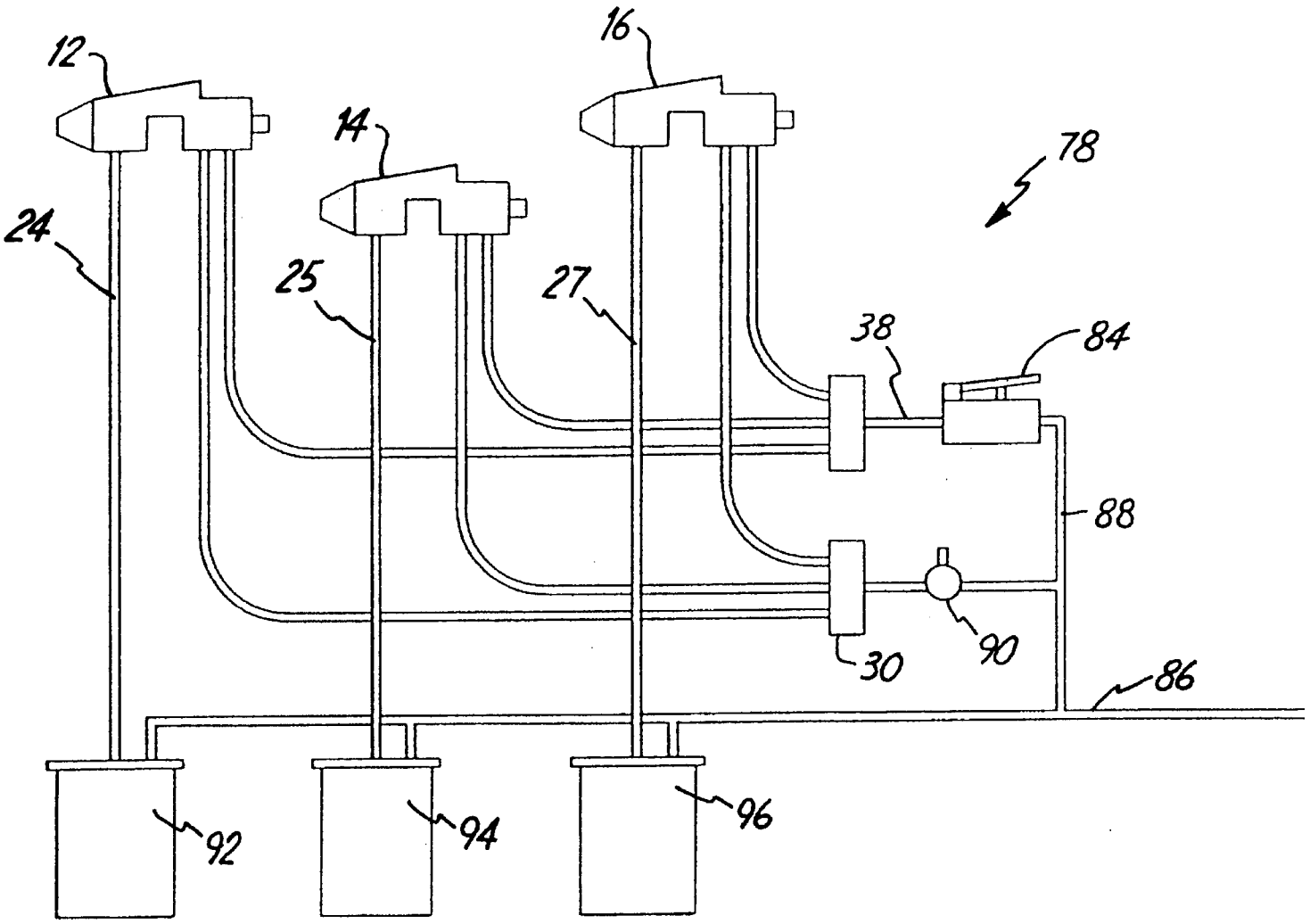
FIG. 4 is a schematic diagram of the coating apparatus of the first embodiment.

FIG. 4 is a schematic illustration of the composition coating system 78 of the present invention. The main supply air hose 86 provides compressed air to the system 78. The primary air hose 88 provides compressed air to the triggering device 84, which is connected to the valve actuation hose 38 for actuating the air cylinders (not shown) in the guns 12, 14 and 16. The main supply air hose 86 is also serially connected to the composition pots 92, 94 and 96 for propelling the viscous coating composition through the viscous coating composition supply hoses 24, 25, and 27 to coating guns 12, 14, and 16, respectively. When the air cylinders are opened, pressurized air from the regulator 90 and distribution manifold 30 flows from the coating guns 12, 14, and 16. Simultaneously, paint flows from the guns 12, 14, and 16 through lines 24, 25 and 27.

Figure 5:
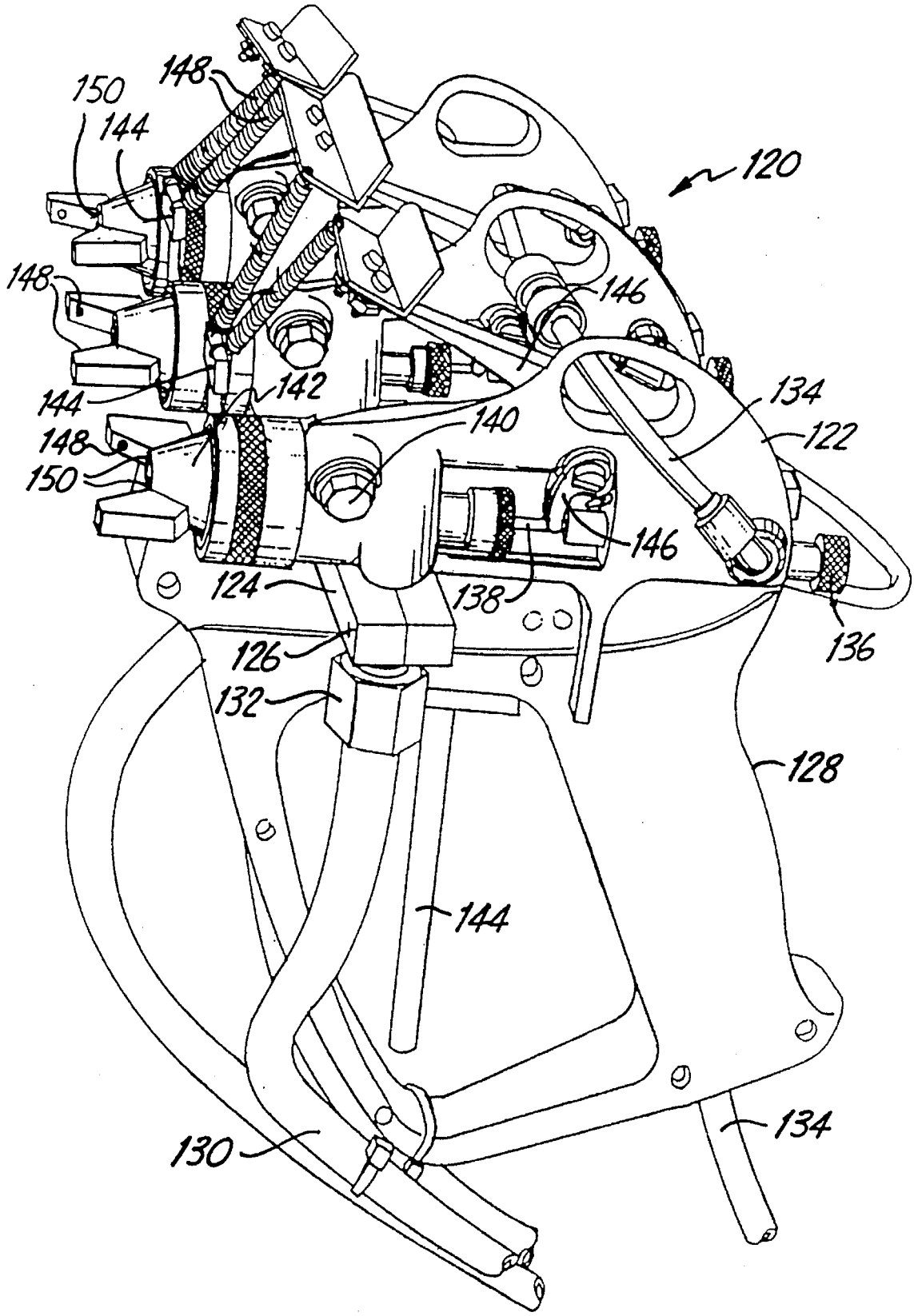
FIG. 5 is a perspective view of the multiple nozzle coating apparatus of the second embodiment of the present invention.

The second preferred embodiment of the present invention is a more light weight and highly portable multiple nozzle coating apparatus 120, as illustrates in FIG. 5. Since each of the coating guns consists of essentially the same elements, only coating gun 122 will be described in detail. It will be understood that all of the components and functionality of coating gun 122 are present in the other two coating guns. Further, a composition pot arrangement as illustrated in FIGS. 3 and 4 may be used in conjunction with coating apparatus 120.

The coating gun 122 and the other two coating guns are attached to a mounting plate 124. A set screw 126 prevents the coating gun 122 from rotating relative to the mounting plate 124. The mounting plate 124 containing the three coating guns is attached to a light weight handle 128. The "Touch-up Gun" from Chung Chia Spray Equipment of Taiwan is known to be suitable for this purpose.

Composition supply hose 130 is attached to the base of the coating gun 122 via a fitting 132 and air supply line 134 is attached to the rear portion thereof. Separate composition and air supply hoses are provided for the other two coating gun. An air supply pressure adjustment valve (not shown) is required for regulating the air pressure used to propel the coating.

An adjustable fluid needle stop 136 is provided to limit the travel of the fluid needle 138. The fluid needle stop allow the operator to independently vary the rate at which the coating composition is propelled from each coating guns.

Because the fluid needle stop 136 and the travel of fluid needle 138 on each gun can be adjusted independently, the primary trigger 144 communicates with the coating gun trigger levers 146 via springs 147, thereby allowing the three coating guns to be activated simultaneously. Any variation in the travel of the fluid needles 138 is compensated for by the springs 147.

One version of the air cap 142 of the present invention has two sets of air hole for propelling the coating composition, the fan holes 148 and forward air holes 150. Air flow from the fan air holes 148 propels the coating composition in a fan shaped spray pattern, while the forward air holes 150 propels the paint in a more conical pattern. A fan air adjustment valve 140 is provided on each coating gun to adjust the air flow from the fan air holes 148, while the air pressure to the forward air holes 150 is controlled by a main air supply flow valve (not shown). Reducing the air flow will create longer strings of coating composition.

By closing valve 140, the coating composition is propelled by air flowing from the forward air holes 150 at a significantly increased forward velocity. The overall flow rate of the viscous coating composition is thereby substantially increase. When used in conjunction with a viscous coating composition, the coating gun 120 may function as a high rate spatter coating gun. The coating gun 122 can also be successfully used for spatter coating at low pressure with water based urethanes of 100 to 105 Kreb units of viscosity.

The coating guns 122 of the second embodiment can also simulate rag or sponge painting by coating at normal air pressure (40–50 psi) with no air to the fan holes 148 and each of the coating guns swivelled away from the center. By pulsing the trigger 144, the tone on tone appearance of rag or sponge painting is achieve for a fraction the cost of known techniques. It will also be understood by those skilled in the art that a variety of means are available for pulsing the supply of compressed air.

When an air cap similar to 142 is used with the coating guns 12, 14, and 16 of the first embodiment under high pressure, the air coming from the fan holes 148 can not be completely turned off and consequently overpowers the air from the forward air holes 150 causing the coating materials to be propelled sideways into the opposite fan hole 148. This situation arises primarily when using water based coatings, which require high air pressure to be propelled. Consequently, the coating guns 12, 14, and 16 can only be used at relatively low pressure and may requiring multiple coats to achieve complete coverage. Since the fan air adjustment valve 140 of the second embodiment allows the air to the fan holes 148 to be completely turned off, the fluid and air pressure can be dramatically increased to accommodate water based coatings, without any of the adverse effects discussed above.

Figure 6:
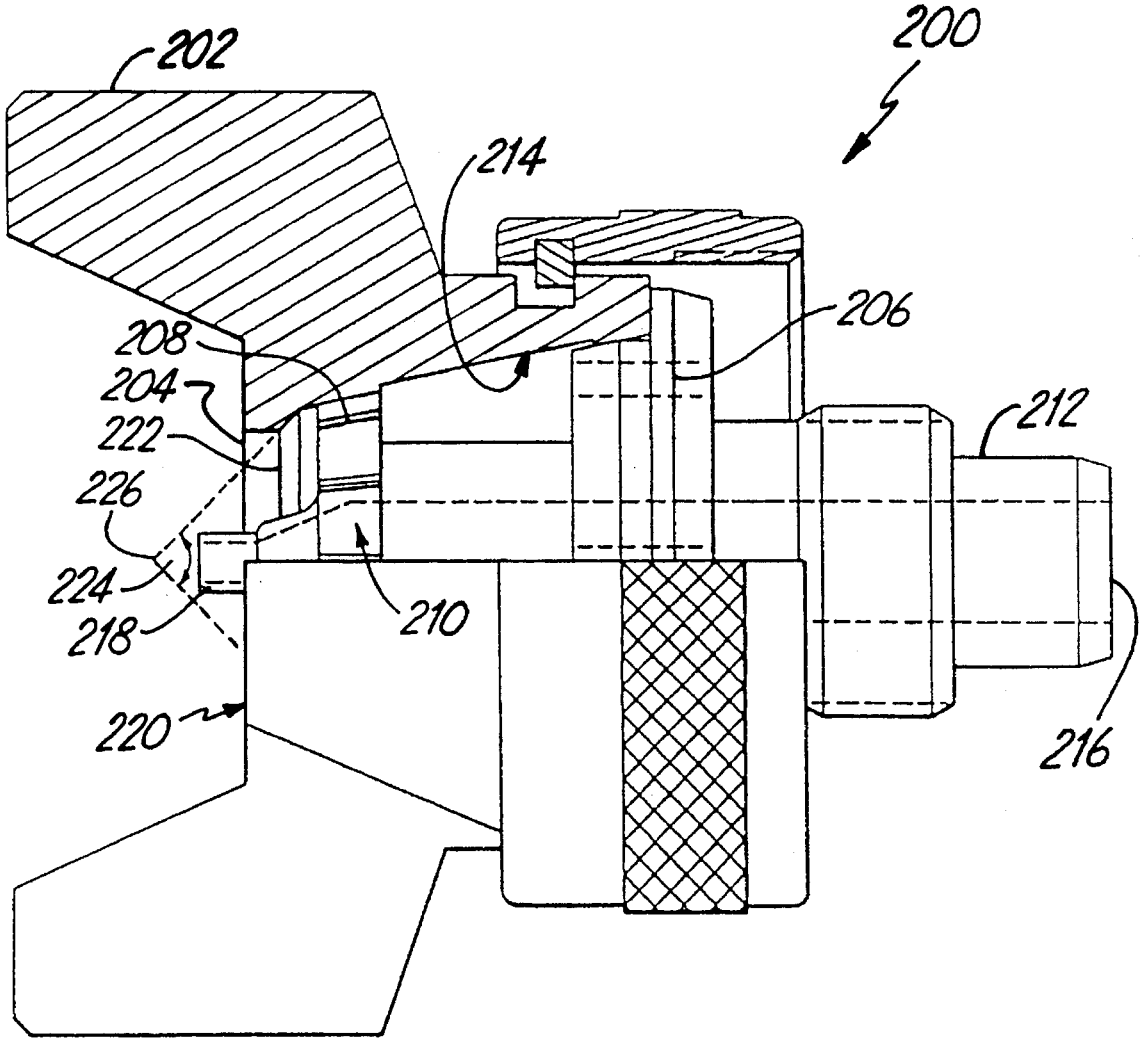
FIG. 6 is a cutaway view of an alternate nozzle arrangement.

FIG. 6 illustrates an alternate embodiment of the nozzle arrangement 200 of FIG. 5. The air nozzle 202 contains a single opening 204 in the front portion through with the coating composition is propelled. The air nozzle 202 does not contain the fan holes 148, as illustrated in FIG. 5, so that the coating composition is propelled in a forward conical pattern. A fluid nozzle 212 with a central aperture 216 is provided, through which the coating composition flows. The compressed air from the coating gun (not shown) flows through rearward air holes 206 toward V-shaped grooves 208 cut in the outside perimeter of the front portion 210 of the fluid nozzle 212.

The V-shaped grooves 208 contact the inside surface 214 of the air nozzle 202, so that small openings are defined. The compressed air is accelerated as it passes through the V-shaped grooves. V-shaped grooves 208 were chosen because they tend to clog less often, although those skilled in the art will recognize that a variety of different shaped grooves may be suitable for this purpose.

The V-shaped grooves 208 of the alternative embodiment of FIG. 6 allow long strings of coating composition to be created, even with low viscosity compositions. Using the alternate nozzle arrangement 200 of the present invention, it is possible to create strings of coating composition with ordinary paints.

As discussed above in relation to the first embodiment of the present invention, when certain high viscosity coatings are used, coating material tends to build up in the space 48 (see FIG. 1) and are periodically discharged onto the surface being coated. The tip of the fluid nozzle 218 extends beyond the front face 220 of the air nozzle 202, so that the coating composition does not collect in the space 222.

The angle 224 of the inside surface 214 of the air nozzle 202 causes the compressed air to be focused at a shear point 226. As the coating composition is extruded through the tip of the fluid nozzle 218, strings are formed. The strings are sheared by the compressed air converging at the shear point 226 and propelled to the surface being coated. By substituting an air nozzle 202 with a different angle 224, different shear points are established, creating correspondingly different length strings.

In either embodiment of the present invention, the coating guns may be used in conjunction with commercially available special effects adapters, also known as spatter, veiling and distress tips. The fluid nozzle model 794 and air nozzles 793 or 797 from Binks Manufacturing Company, of Franklin Park, Ill. are known to be suitable for this purpose. It will be appreciated that any combination of these special effects adapters can be used in the multiple nozzle coating apparatus of the present invention. Each of the special effects adapters creates a different effect. The distress tip is used to create a split blotch effect, simulating wood grain. The veiling tip creates a cobwebbed effect, simulating a marbleized surface. The splatter tip creates splotches of varying size and shape.

Special effects adapters for standard air atomizing coating guns are generally used with stains, lacquers, and enamels. However, these coatings are very thin compared with the coatings of the present invention, with around 20% solids by volume. The special effects nozzles discussed above are not intended to be used with coatings of the viscosity used in the present invention.

The primary parameter of the present invention are the viscosity of the coating composition and the fluid and air pressures. The viscous coating compositions of the present invention tend to contain a high percentage of solids by volume. They are generally extruded at relatively low pressure (approximately 5–25 lbs fluid pressure) from the coating gun nozzles and propelled, rather then atomized, by low air pressure (approximately 0–30 psi air pressure) from the air caps toward the surface to be coated. It should being noted that fluid and air pressures will vary primarily based on line length, paint viscosity, tube diameters, and the desired texture of the surface to be coated, although it will be recognized by those skilled in the art that other variable may effect the fluid and air pressures chosen.

The above combinations of air and fluid pressures produces "pieces" of viscous coating composition in the shape of strings, specks, crescents, or blotches. Because the viscous coating compositions are not atomized, the "pieces" of viscous coating composition from each nozzle are insufficient to provide complete coverage of the area to be coated. However, the combination of the three coating guns propels a sufficient volume of viscous coating composition to partially or substantially cover the area to be coated, producing a surface with distinctively separate overlapping pieces of viscous coating composition. Each of the three coating guns can be set up independently. Fine specks can come from one head, chopped strings from another, and pebble-sized random shapes from the third, or any combination thereof.

In operation, the method of the present invention involves choosing a coating composition viscosity to create the desire texture. The air and fluid pressures are then adjusted to propel paint of the desired texture.

Generally, the viscous coating compositions are formulated from a carrier, a polymeric film-forming agent, coating pigment and a viscosity and rheology control agent. The coating pigment includes fillers, metal oxides such as titanium oxide, organic dyes, inorganic pigments and colorants or particulate metals or non-metals. The film-forming polymer may be a binder such as a drying resin or a thermoset polymer, a curable polymer or an alkyd polymer system. Polyurethanes, polycarbonates, polyesters, polyolefins, fatty olefins, tall oils and the like are examples of such polymer film forming agents. Generally these film forming agents are derived from common coating materials which fall into the following viscosity categories:

| | |
|---|---|
| Very Thin | (14–16 seconds on a #2 Zahn cup; 1–250 centipoise) |
| Dyes | |
| Stains | |
| Inks | |
| Iridescent prep coats | |
| Thin | (16–20 seconds on a #2 Zahn cup; 250–500 centipoise) |
| Sealers | |
| Lacquers | |
| Primers | |
| Acrylics | |
| Water-borne urethanes | |
| Iridescences | |
| Medium | (19–30 seconds on a #2 Zahn cup; 500–5,000 centipoise) |
| Lacquers - Varnishes | |
| Wax Emulsions | |
| Primers - Fillers | |
| Epoxies - Urethanes | |
| Synthetic Enamels | |
| Elastomerics | |
| Iridescences | |

-continued

| | |
|---|---|
| Acrylic Enamels | |
| Deck Coatings | |
| High Solids | (30 seconds and up on a #4 Zahn cup; 3,000–25,000 centipoise yet can be pumped and extruded with standard large fluid nozzles) |
| Enamels | |
| Acrylic Emulsions | |
| Cementitious | |
| Roofing Elastomers | |
| PVC's, etc. | |
| 100% Solid Epoxies | |
| Epoxies | |
| Phenolics | |
| Waterproofers | |
| Heavy | (creme-like; 10,000–50,000 centipoise) |
| Fillers | |
| Textures | |
| Fire Retardants | |
| Road Marking | |
| Composition | |
| Cellular Plastisols | |
| Roof Coatings | |
| Liquified Plastics | |
| Elastomerics | |
| Acrylic Exterior Coatings | |
| Non-slip Coatings | |
| Synthetic Stucco | |
| Bridge Coatings | |
| Block Compositions | |
| Roof Coatings | |
| Tennis Court Coating | |
| Self-level Floor Coating | |
| Adhesives | (500–25,000 centipoise) |
| Neoprene | |
| Waterbase | |
| Solvent Base | |
| Contact Cement | |
| Ceramics | (15,000–25,000 centipoise) |
| Glazes, Engolres | |
| Porcelain Enamels | |
| Gunite | |
| Hammertone Enamels | (2,000–5,000 centipoise) |
| Wrinkle Enamels | |
| Cements | (25,000 to semi-paste) |
| Foams | |
| Coil Coatings | |
| Any liquid or pumpable semi-liquid | |

Easily liquified solids can also be used, such as polyvinylchloride and other plastics or porcelain.

The carrier is any known aqueous or organic medium used for composition and coating compositions. Examples include water, water and alcohol mixtures, water and inorganic salt mixtures, aromatic spirits, turpentine, aliphatic ketones, aromatics such as toluene, xylene and the like, halogenated hydrocarbons, acrylics, urethanes, epoxies, and fluorochemicals.

The viscosity and rheology control agent is fumed silica, particulate magnesium silicate, fine (10 to 200 microns) glass microspheres, talc, methylsil, hydroxylic, fluorocarbon surfactants, hydrocarbon surfactants, or silicone.

Additional components can also be included in the viscous coating compositions including extenders, catalysts, curing agents, film forming agents, stabilizers, emulsifiers, texanol-co-solvent-tamol dispersants, ethylene glycol flow agents, ucar thickener, and the like.

Commercial coatings will usually not give a predictable speck, blotch, crescent, string or granite-like look. Such coatings are formulated for good opacity at thin film sizes, good flow for brush and roller application, and proper cure times for thin film thicknesses. In contrast, the viscous coating compositions of the present invention have high wet body or high film stability, good cure times in thick droplets and strings, good hang, good adhesion properties for thick, irregular spots, patches, strings and lines. If such thick irregular coverings were attempted with ordinary coatings, over-stress would occur during curing and the irregular coating patches would lose most of their adhesion to the undersurface. Solvent entrapment would also be a problem with ordinary formulations such that a high solids formulation prepared according to typical recipes would peel, crack, remain soft, improperly cure and the like. In contrast, the formulations of the present invention utilize pigments, fillers and extenders with low oil absorption rates and are moisture cured from within, so that the above problems are overcome. Accordingly, the preferred coating composition embodiments of the present invention incorporate co-reactive diluents to prevent solvent entrapment and to cause rapid, thorough cure. For example, thermoset polymers such as amine epoxies prevent solvent entrapment and cause rapid thorough cure. Dry pigments can also be incorporated to prevent solvent entrapment. For coating compositions having fine specifications, water is the preferred solvent.

According to the invention, the coating compositions interact with the apparatus and coating process to provide irregular multicolored coating patterns. The molecular attraction within is set for each pattern. The coating compositions are formulated as indicated above so that they maintain wet strength and body integrity as applied. These properties essentially prevent the flow of the irregular coatings over the coated surface and avoid their ready mixing. As a result, the spots, strings, patches and irregular coverings remain. They do not meld together into a uniform and unicolor coating over the entire surface of the substrate. The coating compositions are applied simultaneously in a single step into a substantially overlapping circular pattern. The pattern produced is a three-colored, predictable arrangement of the chosen texture and color combinations on the flat plane of the substrate.

The multi-color single step process of the present invention can be used on interior and exterior surfaces. Because the coating composition is not atomized during this process, the coating process is not significantly effected by air currents. Further, because the equipment is totally portable and any type of composition can be used, the method and apparatus of the present invention can be used on any surface.

The following examples further illustrate the patterns and designs produced using the apparatus, compositions and method of the present invention. These examples are not to be regarded as limitations of the invention which is fully characterized by the foregoing description. Other embodiments will be readily apparent to those of skill in the art.

EXAMPLE 1

Speck over solid

This example produces a fine speck over a solid color first coat in any sheen.

The coating composition for the solid undercolor is a grey pigmented polyurethane (from aromatic diisocyanate and dihydroxy compounds) emulsion in water with sorbitan 200 surfactant (solids content of 40%). The speck composition was the same water emulsion polyurethane but with a red pigment and fumed solid or magnesium silicate to adjust the viscosity to 300 to 500 centipoise and a slightly flatten the sheen. The total solids content is 80% with 2% viscosity agent.

A three coating gun arrangement using various sized fluid and air nozzles is used. The first coat is the solid undercoat which is applied as a solid background. The coating composition has a low enough viscosity to produce complete and even spreading of the specks on the substrate when the nozzle pressure is high enough to atomize. Application of the undercoating at a pressure of 50 psi resulted in the solid background production.

The overlaid pattern of the second coat according to the invention is produced at low pressure and five psi fluid pressure at the nozzle. The coating is applied through the three gun arrangement to speckle the background with specks of red overlaid coating. Two coats, a base coat and a speck coat, are required. The pattern is fine specks of irregular shape.

By changing the pigments of compositions in the second and third applicators to blue and white, and applying the second coat under the same low pressure conditions described above, a red, white and blue specked pattern on a gray background can be produced. The specks form a stippled surface and are discretely separated from each other. The viscosity and wet strength of the composition is sufficient to prevent composition flow on the surface after the composition has been applied. Although the gray background is eventually obliterated if coating with the second coat is continued, the second coat application is terminated when it appears that the speck density is sufficient to provide the desired pattern. Usually, the speck density are slightly less than that needed to produce a substantially heavy number of overlapping specks.

EXAMPLE 2

Pebble

A fine "Y8" pebble can be achieved with an acrylic/urethane formulated with a viscosity to be between 600–900 centipoise. The complete formulation is the same as for Example 1. An undercoat is applied with a brush, roller, or spray, and second coat is applied with the coating gun of the present invention. Sheens can be set by adding a flattening bases, such as silica and CAB-O-SIL M5. A distress gun adapter set on the coating guns, a fluid nozzle, and a conical air cap are used to form the radius of a circular triangle arrangement. As the size and thickness of the specks increase a different cure-drying system from simple air dry coatings should be used for thorough cure, such as a bisphenol amine adduct epoxy.

EXAMPLE 3

Aluminum Coating

This example adapts a water-based urethane with Silberline automotive grade inhibited aluminum paste for use on sheetrock, concrete, ceiling tile and other non-metallic surfaces. The formulation is as follows: acrylic/urethane with 15% by weight solids of aluminum. It exhibits an excellent brushed aluminum iridescent look. Conventional air spraying techniques are used.

EXAMPLE 4

Surfacer

A clear self-leveling glycidol ether epoxy surfacer Shell (Epon Resin #8132 Bisphenol "A" Resin and 55 PPH Pacific Anchor Ancamine MCA) can be used for floors with a top-coating of one, two, and three-colored large epoxy patches, chopped strings and pebble-sized specks using the coating methods discussed above. The finish coat consists of Unocal 844 colorant using the three color process gun of the present invention. The second coat is applied before the first is cured, which allows intra-coat adhesion instead of inter-coat. This allows for an incredibly strong non-slip, colorful floor. The epoxies used in the present invention offer limitless color choices.

EXAMPLE 5

Urethane Coating

Pigment, extenders and fillers are incorporated into an acrylic/urethane coating. When used in an apparatus according to the design of the present invention, the resulting composition will agglomerate in front of the fluid nozzles prior to transport to the surface being coated. This characteristic causes the coating to look mingled on the surface, without being mixed together. This effect can be obtained from any of the high-viscosity coatings above, such as acrylics or urethanes. The mingled color effect is also three-dimensional, excellent for non-slip surfaces.

EXAMPLE 6

Cobweb Effect

A cobweb effect can be created by giving the coatings a gelatin-like viscosity which is thixotropic and by only partially opening the fluid needle shut-off during coating. This eliminates the need for air cores in the fluid nozzles that cause a spiraling effect of the propelling air.

EXAMPLE 7

Wood Effect

The three-head adjustable coating apparatus of the present invention can distress any surface to look like wood. The three-headed adjustable process gun can be used to put different colors of extruded viscous acrylic-urethane solid colored strings of about ⅜" to ½" in length over an acrylic/urethane semi-transparent stain applied with a rug-covered roller which is commonly used with texture paint to pucker it. The semi-transparent stain is applied over a lighter-colored stain to create a multi-toned background for the strings. You can achieve an effect similar to this by triggering the process gun while moving it. The gun is set at higher pressure to atomize the darker color stain.

EXAMPLE 8

Background Coating

An aluminum-filled clear urethane, water-based or solvent-based, can be used as a background coating. It is especially useful over sheetrock, concrete block or ceiling tile to create a tone-on-tone iridescent background. The iridescent aluminum gives a multi-colored effect in the light when viewed from different angles.

EXAMPLE 9

Cementitious Compositions

By adjusting cementitious compositions at different viscosities from each coating gun, a three-textured surface can be created, giving different light reflections and allowing a three-color effect, even though the coatings are all the same color. The typical formulation requires 3 quarts of acrylic latex, 3 quarts of water and 90 lbs. of #1 Portland cement, plus some colorant. The texture is roughly similar to stucco.

EXAMPLE 10

Granite-Like Colorations

The method and apparatus of the present invention can be used to make granite-like colorations on floors, which is then encapsulated in a clear urethane.

EXAMPLE 11

Sponge-Compositioned Appearance

Coatings in color can be applied over a dark background to create a sponge-compositioned appearance (i.e., a translucent, granite-like appearance). This is done by applying a background and three color specks, and then rotating a wet sponge on the surface in a general pattern while the paint is still wet. The method and apparatus of the present invention is approximately 10 times faster than traditional sponge compositioning.

EXAMPLE 15

Radio Frequency Shield Coating

Multi-color epoxy, urethanes and acrylics can be applied over silver-based epoxy radio frequency shield coating on the outside surfaces of business machines and electronic equipment.

What is claimed is:

1. A method of forming a textured coating on a stationary surface, comprising:

providing a plurality of fluids under pressure;

providing a plurality of fluid nozzles, each fluid nozzle having an outlet end;

simultaneously delivering the plurality of fluids, one to each fluid nozzle, to provide simultaneous and continuous fluid streams simultaneously exiting the outlet ends of each of the fluid nozzles;

providing a gas under pressure;

delivering the gas under pressure to an area proximate the outlet ends of the fluid nozzles, the gas being delivered at a pressure sufficient to propel the fluid exiting the outlet ends of the fluid nozzles to the surface, but being at a pressure low enough to substantially avoid atomizing the fluid being delivered to the surface; and the plurality of fluids under pressure being delivered having properties such that the fluids substantially avoid flowing on the surface and mixing while being propelled to the surface.

2. The method of claim 1 wherein simultaneously delivering the plurality of fluids comprises:

continuously delivering the plurality of fluids to the fluid nozzles.

3. The method of claim 1 and further comprising:

directing the gas under pressure in the area proximate the outlet ends of the fluid nozzles to break the fluid streams exiting the outlet ends of each of the fluid nozzles into fluid pieces.

4. The method of claim 3 wherein directing the gas comprises:

focusing the gas under pressure at points spaced from, and substantially aligned with, the outlet ends of each of the fluid nozzles.

5. A method of forming a textured coating on a stationary surface, comprising:

providing a plurality of fluids under pressure;

providing a plurality of fluid nozzles, each fluid nozzle having an outlet end;

simultaneously and continuously delivering the plurality of fluids, one to each fluid nozzle, to provide a fluid stream exiting the outlet ends of each of the fluid nozzles;

providing a gas under pressure;

delivering the gas under pressure to an area proximate the outlet ends of the fluid nozzles, the gas being delivered at a pressure sufficient to propel the fluid exiting the outlet ends of the fluid nozzles to the surface, but being at a pressure low enough to substantially avoid atomizing the fluid being delivered to the surface; and the plurality of fluids under pressure being delivered having properties such that the fluids substantially avoid flowing on the surface and mixing while being propelled to the surface.

6. The method of claim 5 and further comprising:

directing the gas under pressure in the area proximate the outlet ends of the fluid nozzles to break the fluid streams exiting the outlet ends of each of the fluid nozzles into fluid pieces.

7. The method of claim 6 wherein directing the gas comprises:

focusing the gas under pressure at points spaced from, and substantially aligned with, the outlet ends of each of the fluid nozzles.

8. A method of forming a textured coating on a stationary surface, comprising:

providing a plurality of fluids under pressure;

providing a plurality of fluid nozzles, each fluid nozzle having an outlet end;

simultaneously and continuously delivering the plurality of fluids, one to each fluid nozzle, to provide a fluid stream exiting the outlet ends of each of the fluid nozzles;

providing a gas under pressure;

delivering the gas under pressure to an area proximate the outlet ends of the fluid nozzles, the gas being delivered at a pressure sufficient to propel the fluid exiting the outlet ends of the fluid nozzles to the surface, but being at a pressure low enough to substantially avoid atomizing the fluid being delivered to the surface;

directing the gas under pressure in the area proximate the outlet ends of the fluid nozzles to break the fluid streams exiting the outlet ends of each of the fluid nozzles into fluid pieces; and the plurality of fluids under pressure being delivered having properties such that the fluid pieces substantially avoid flowing on the surface and mixing while being propelled to the surface.

9. The method of claim 8 wherein directing the gas comprises:

focusing the gas under pressure at points spaced from, and substantially aligned with, the outlet ends of each of the fluid nozzles.

10. The method of claim 9 wherein providing the plurality of fluids, comprises:

providing the fluids with rheology and viscosity control agents such that the fluid pieces substantially avoid flowing on the surface and mixing while being propelled to the surface.

* * * * *